US005584722A

United States Patent [19]

Heng et al.

[11] Patent Number: 5,584,722

[45] Date of Patent: Dec. 17, 1996

[54] SLOT CONNECTOR TERMINAL STRUCTURE FOR CONNECTING AN ELECTRICAL WIRE TO A PART MOUNTED INSIDE A HOUSING

[75] Inventors: Jean-Paul Heng, Lyon; André Marmonier, Bron; Ariel Ruiz, Villeurbanne, all of France

[73] Assignee: Entrelec S.A., Villeurbanne, France

[21] Appl. No.: 360,962

[22] Filed: Dec. 21, 1994

[30] Foreign Application Priority Data

Dec. 29, 1993 [FR] France ..... 93 15473

[51] Int. Cl.[6] ..... H01R 4/24

[52] U.S. Cl. ..... 439/395

[58] Field of Search ..... 439/389, 391, 439/395–404

[56] References Cited

U.S. PATENT DOCUMENTS

| | | | |
|---|---|---|---|
| 3,772,635 | 11/1975 | Frey et al. | 439/395 |
| 4,522,459 | 6/1985 | Hardesty et al. | 439/395 |
| 4,840,579 | 6/1989 | Heng et al. | 439/395 |

FOREIGN PATENT DOCUMENTS

| | | | |
|---|---|---|---|
| 0152690A1 | 8/1985 | European Pat. Off. | 439/395 |
| 0265321A1 | 4/1988 | European Pat. Off. | 439/395 |

*Primary Examiner*—Gary F. Paumen
*Assistant Examiner*—Brian J. Biggi
*Attorney, Agent, or Firm*—Sughrue, Mion, Zinn, Macpeak & Seas

[57] ABSTRACT

A slot connector terminal structure for an electrical wire, in particular for an electrical terminal block, in which structure at least one conductive connector part is held stationary in a housing (5) provided with a wire-insertion through opening (23) extending facing an insulation-displacement and core-retaining slot (6) in the connector part, which opening makes it possible firstly for a wire to be connected to be inserted transversely above the slot, and secondly for the wire to be subsequently held stationary via its sheath, the housing further including positioning means for positioning a special connection tool, which positioning means are implemented in the form of a projecting element through which a moving blade of the tool penetrates. The projecting element is provided with a slot (13) into which the wire-insertion through opening (23) opens, which slot makes it possible for the blade of a tool to penetrate into and slide along the slot inside the housing.

2 Claims, 1 Drawing Sheet

SLOT CONNECTOR TERMINAL STRUCTURE FOR CONNECTING AN ELECTRICAL WIRE TO A PART MOUNTED INSIDE A HOUSING

BACKGROUND OF THE INVENTION

The invention relates to a slot connector terminal structure for an electrical wire that is to be connected to a conductive part inside a housing.

Document EP-B-0 265 321 to the Assignee describes a connector terminal structure that includes a conductive connector part provided with an insulation-displacement and core-retaining slot for a wire, which part is held stationary in a recess of a housing made of an insulating material. The housing is provided both with a wire-insertion through opening that extends facing the slot in the connector part, and also with positioning means for positioning a special connection tool having an insertion blade. The positioning means are constituted by a projecting element of the housing, which element is provided with a central opening through which the insertion blade of a special tool can penetrate, the insertion blade being rigid and mounted to move in translation so as to slide along the insulation-displacement and core-retaining slot, thereby pushing a wire to be connected into said slot. The wire must be initially placed transversely to the slot and above an entrance thereof which guides the wire towards the core-retaining portion of the slot after having displaced the insulating sheath of the wire. The blade is placed against the wire so as to push it transversely into the slot.

In the embodiment disclosed in that document, it is necessary to be able to insert a wire perpendicularly to the wire-insertion through an opening situated in a face of the housing. Unfortunately, in certain applications relating to terminal blocks or other electrical appliance housings that are mounted close to a wall, e.g. inside a cabinet, it is not easy to insert a wire perpendicularly to the through opening which is provided for it in the housing and via which it is to penetrate.

SUMMARY OF THE INVENTION

An object of the invention is to provide a connector terminal structure enabling that drawback to be remedied by enabling the wire to be initially inserted otherwise than facing the wire-insertion through opening provided for it, prior to being finally positioned in the opening.

Therefore, the invention provides a slot connector terminal structure for an electrical wire, in particular for an electrical terminal block, in which structure at least one conductive connector part is held stationary in an insulating housing provided with a wire-insertion through an opening extending facing an insulation-displacement and core-retaining slot for displacing the insulation on and retaining the core of a wire, which slot is assigned to connecting the core of the wire electrically to the connector part, and is provided in a wall of the connector part, said wire-insertion through opening making it possible firstly for a wire to be connected to be inserted transversely above an insulation-displacement entrance of the slot in the connector part, and secondly for the wire to be subsequently held stationary via its insulating sheath, the housing further including positioning means for positioning an external connection tool having an insertion blade, the positioning means being implemented in the form of a projecting element through which the insertion blade penetrates, which blade is rigid and is mounted to move in translation, so as to slide along the insulation-displacement slot during wire insertion.

According to a characteristic of the invention, the housing includes at least one projecting element provided with a tool-insertion slot which extends the wire-insertion through the opening and opens out into one end thereof so as to make it possible firstly for the wire to be inserted into the housing prior to connection, and secondly for the insertion blade of a tool to penetrate into and slide along the slot in the connector part on connection.

According to another characteristic of the invention relating to a slot connector terminal structure for a housing that is provided with a wire-insertion through opening formed of two portions, namely a portion forming a slot for holding the sheath of a wire stationary, which slot is disposed facing the insulation-displacement and core-retaining slot in the connector part, and a portion making it possible for a wire to be connected to be inserted transversely above the insulation-displacement entrance of the insulation-displacement and core-retaining slot, the portion making it possible for a wire to be inserted is itself in the form of a slot which is wider than and extends the slot for holding the sheath of the wire stationary, and which is continued by the tool-insertion slot, which extends perpendicular to it.

BRIEF DESCRIPTION OF THE DRAWINGS

The invention, and the characteristics and advantages thereof are described in more detail below with reference to the accompanying drawing, in which.

DETAILED DESCRIPTION OF THE PREFERRED EMBODIMENT

Figure 1:
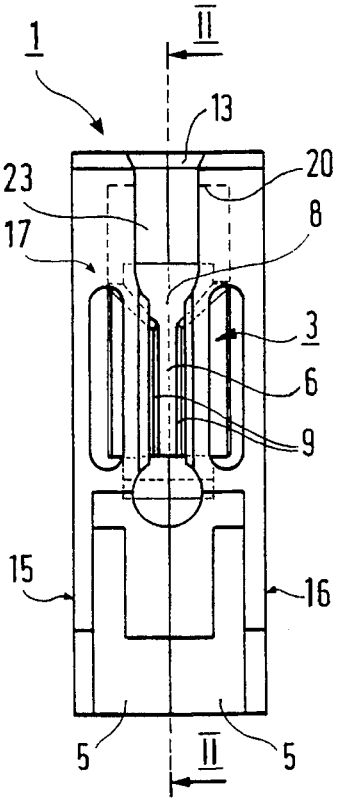
FIG. 1 is an end view of a connector terminal structure of the invention.

The connector terminal structure shown in FIG. 1 is derived from the connector terminal structure disclosed by Document EP-B-0 265 321, as indicated above. It is therefore designed to be integrated in electrical equipment 1 (an electrical unit or appliance) so as to connect at least one electrical wire 2 thereto.

Figure 2:
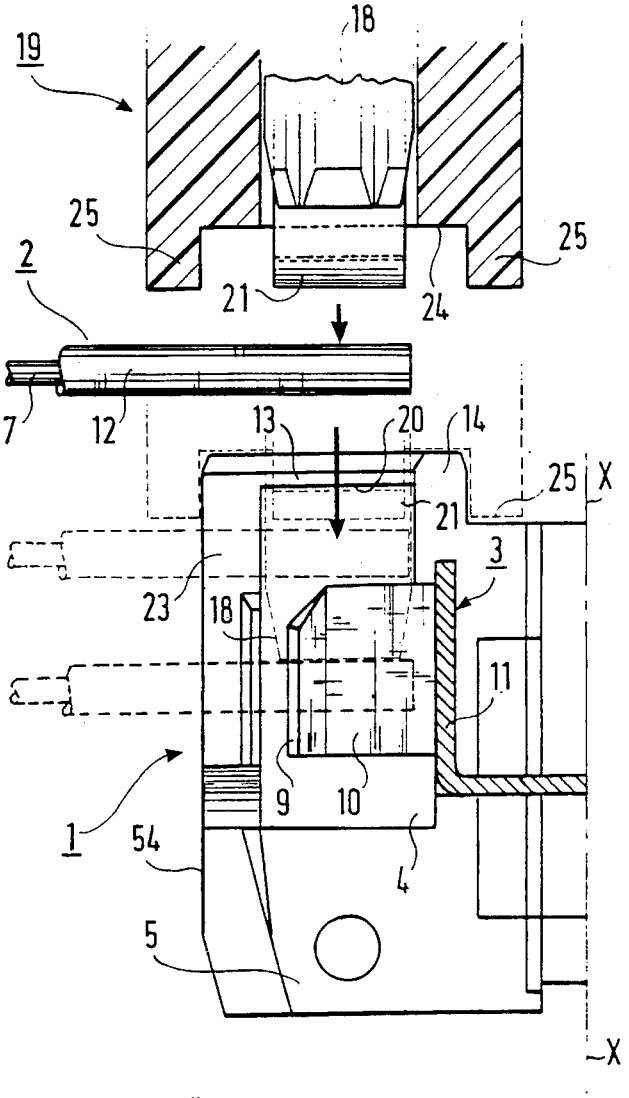
FIG. 2 is a section view on II—II of the connector terminal structure of FIG. 1 showing the successive characteristic steps involved in connecting a wire by means of a suitable connection tool.
Figure 4:
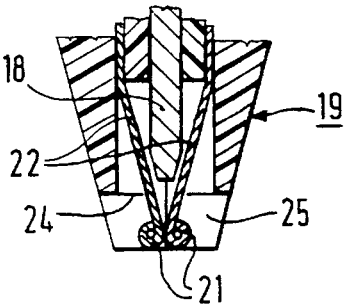
FIG. 4 is a fragmentary section view through the end of a connection tool for a connector terminal structure of the invention.
Figure 3:
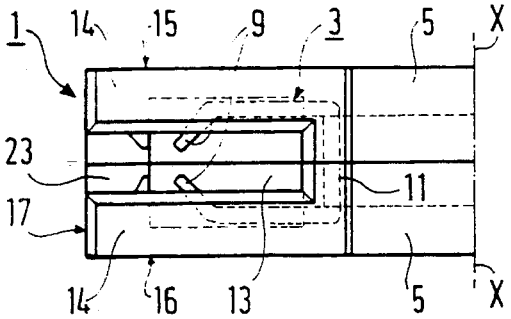
FIG. 3 is a plan view of the connector terminal structure of the invention.

In the example given, the electrical equipment is a terminal block, only one half of which is shown in FIG. 2, the other half being symmetrical about a midplane XX' considered to be perpendicular to the plane of the drawing.

Each half-block is provided with a slot connector terminal structure including a conductive connector part 3 designed to receive at least one electrical wire.

In this embodiment, the connector part 3 can be electrically connected to the corresponding connector part of the second connector terminal structure (not shown) of the terminal block in known manner.

The connector part 3 is held stationary in a recess 4 provided for that purpose in an insulating housing 5 which contains at least part of, and in this example all of, the electrical equipment 1. For example, the housing 5 may be constituted by assembling together two complementary half-shells, as in this example, or by assembling together a shell and a lid.

Each part 3 is provided with an insulation-displacement slot 6 for displacing the insulation on and retaining the conductive core 7 of the wire(s) 2 to be connected. In this example, the slot is rectilinear and opens out into an insulation-displacement entrance 8 at one of its two ends. In this embodiment, the slot 6 is provided along a shaped portion of the part 3, e.g. obtained by punching the part so as to subject it to cutting-out, folding, and optionally localized thinning. In this example, the shaped-section portion of the part 3 has a hollow polygonal cross-section which approximately corresponds to a channel section whose free ends have been folded in towards each other at equal oblique angles. The shaped portion includes two inwardly-folded end lips 9 which correspond to the above-mentioned free-ends, and which flank the slot 6 that is defined by them.

Each one of two parallel walls 10 (only one of which is shown in FIG. 2) carries a lip 9. The parallel walls cooperate with an end wall 11 disposed perpendicular to them to hold the part 3 stationary in its recess 4.

In this example, it is assumed that the insulation-displacement entrance 8 in the part 3 is obtained by forming symmetrical cut-outs in the lips 9 at one end of each lip, which cut-outs enable a flared entrance to be obtained, thereby making it possible successively to guide the electrical wire to be connected, and to cut through the insulating sheath 12 of the wire.

The lips 9, the parallel walls 10 and the end wall define a cavity which opens out to the outside of the housing 5 via a "tool-insertion" blind slot 13 which is positioned in the same zone of the housing as the insulation-displacement entrance 8, i.e. in the top portion of the housing shown in FIG. 1.

In this example, slot 13 opens out at tool-positioning means including a projecting element 14 which projects from that portion of the housing in which it is located, i.e. from the top portion of the housing 5 shown in FIG. 2.

In this embodiment, the element 14 is rectangular in shape, and it extends in alignment with the walls 15, 16, and 17 of the housing 5. Slot 13 passes through part of the element, extends parallel to the walls 10 of the part 3 and the walls 15 and 16 of the housing, above the cavity in the part 3, and opens out in face 17.

Slot 13 is disposed so as to enable a blade 18 of a connection tool 19 to be inserted into the housing 5, and more particularly into slot 6, on both sides of the lips 9, i.e both inside and outside the part 3 in the vicinity of slot 6.

The connection tool 19 in this example is of the type described in above-mentioned Document EP-B0 265 321. Therefore, it is not described in full below.

Two parallel sides of slot 13 are provided with respective rims such as 20 which define the width of slot 13 and which enable the connection tool 19 to be retained via bulging ends 21 carried by flexible blades 22 of the tool, which blades 22 move apart when the tool is actuated and blade 18 is driven out beyond the flexible blades. In one embodiment, positioning the bulging ends 21 of tool 19 under the rims 20 is facilitated by the presence of optionally through recesses situated facing each other in the walls under the overhanging rims 20, each recess (not shown) being organized to receive a respective bulging end.

The housing 5 is also provided with a wire-insertion elongate through opening 23 which extends facing slot 6 in the part 3 and therebeyond. The opening 23 is provided to enable a wire 2 to be inserted above the insulation-displacement entrance 8 to a position enabling the wire to be inserted transversely into the slot 6, and in this example perpendicularly thereto, so as to displace the sheath 12 of the wire and so as to jam its core 7. Such positioning of the wire is shown in dashed lines in the middle position in FIG. 2. The opening 23 also enables the wire 2 to pass out through the housing and to be held in position once the wire has been connected to the connector part 3.

In the embodiment shown, the tool-insertion slot 13 opens out into the opening 23 relative to which it extends perpendicularly in this example.

It is therefore possible to take advantage of the opening formed by slot 13 to position a wire 2 correctly in the opening 23 at the insulation-displacement entrance 8 prior to using the tool 19 to connect the wire 2 to the part 3 during a connection operation.

In the embodiment shown, the opening 23 includes a first portion in the vicinity of slot 13. The first portion itself constitutes a slot whose width is greater than the maximum diameter of a wire 2 to be connected, e.g. said width corresponds to the width of slot 13, so as to facilitate positioning a wire relative to the insulation-displacement entrance 8 prior to connection.

The opening 23 also includes a rectilinear second portion in which a connected wire 2 is locally held stationary, as represented by the wire drawn in dashed lines in the lowest position in FIG. 2. The rectilinear second portion is provided in the vicinity of slot 6, and it is designed to retain the wire 2 by jamming its sheath 12 once the wire 2 has been pushed to the connection position that is provided for it by the action of a blade 18 of a connection tool 19.

In the embodiment shown, and in known manner, at least one auxiliary aperture, and in this example two auxiliary apertures are provided parallel to the rectilinear second portion of the opening 23 so as to enable those zones of the housing which jam the sheath 12 of a wire to be deformed without the outside dimensions of the housing 5 being modified, when the sheath of at least one wire 2 is held stationary in the second portion of the opening 23.

A wire 2 may be connected to a connector terminal structure such as the above-defined connector terminal in the manner disclosed by Document EP-B-0 265 321. The wire 2 must be initially placed inside the housing 5 above the insulation-displacement entrance 8 of the part 3, as shown in dashed lines in the middle of FIG. 2. The tool 19 is then positioned on the projecting element 14 so as to cover it. For that purpose, the tool has, for example, a central abutment zone 24 and two side centering elements 25, in the form of two extensions in this example, which ensure that the tool is accurately positioned on and in abutment with element 14. In this way the blade 18 is accurately positioned relative to the slot 6 in the part 3, and the bulging ends 21 of the flexible blades 22 are accurately positioned relative to the rims 20 of element 14. By actuating the tool, blade 18 is driven so that it slides between and projects from the bulging ends 21 so that it moves them apart and pushes them under the respective rims, and optionally into respective ones of the positioning cavities provided for that purpose and at that level.

By being driven out from the tool in this way, the blade 18 presses against the sheath of the wire 2 to be connected, thereby pushing the wire both into slot 6 via the insulation-displacement entrance 8, and also into the rectilinear portion of the opening 23, the blade also penetrating into slot 6 and skirting the edge of the opening 23 as it slides. The sheath of the wire 2 is cut by the lips 9 on the connector part 3 at the insulation-displacement entrance 8, and the core of the wire is jammed in slot 6, while the sheath is jammed in the rectilinear portion of the opening 23.

Blade 18 is retracted at the end of the connection action, thereby enabling the bulging ends 21 to come back far enough towards each other to pass between the rims 20 of slot 13, so as to enable the tool 19 to be removed once the wire has been connected.

What is claimed is:

1. In a slot connector terminal structure for an electrical wire (2), and in particular for an electrical terminal block, in which structure at least one conductive connector part (3) is held stationary in an insulating housing (5) provided with a wire-insertion through opening (23) extending facing an insulation-displacement and core-retaining slot (6) for displacing the insulation on and retaining the core of a wire, which slot is assigned to connecting the core of the wire electrically to the connector part, and is provided in a wall of the connector part, said wire-insertion through opening making it possible firstly for a wire to be connected to be inserted transversely above an insulation-displacement entrance (8) of the slot (6) in the connector part, and secondly for the wire to be subsequently held stationary via its insulating sheath (12), the housing (5) further including positioning means for positioning an external connection tool (19) having an insertion blade (18), the positioning means being implemented in the form of a projecting element (14) through which the insertion blade (18) penetrates, which blade is rigid and is mounted to move in translation, so as to slide along the insulation-displacement slot during wire insertion, the improvement wherein said housing includes at least one projecting element provided with a tool-insertion slot (13) which extends the wire-insertion through opening (23) and opens out into one end thereof so as to make it possible firstly for the wire to be inserted into the housing prior to connection, and secondly for the insertion blade of a tool to penetrate into and slide along the slot in the connector part on connection.

2. A slot connector terminal structure for an electrical wire, according to claim 1, wherein said housing is provided with a wire-insertion through opening (23) formed of two portions, a first portion forming a slot for holding the sheath of a wire stationary, which slot is disposed facing the insulation-displacement and core-retaining slot (6) in the connector part, and a second portion making it possible for a wire to be connected to be inserted transversely above the insulation-displacement entrance of the insulation-displacement and core-retaining slot, the improvement further comprising the second portion being itself in the form of a slot which is wider than and extends the slot for holding the sheath of the wire stationary, and which is continued by the tool-insertion slot (13), which extends perpendicular to it.

* * * * *